US007651209B2

(12) United States Patent
Haines et al.

(10) Patent No.: US 7,651,209 B2
(45) Date of Patent: Jan. 26, 2010

(54) FLOW PASSAGE

(75) Inventors: Paul Mark Haines, Lebanon, OR (US); Mark A. Devries, Albany, OR (US); Michael Martin, Newport Beach, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 369 days.

(21) Appl. No.: 11/180,281

(22) Filed: Jul. 13, 2005

(65) Prior Publication Data

US 2007/0013754 A1 Jan. 18, 2007

(51) Int. Cl.
*B41J 2/175* (2006.01)

(52) U.S. Cl. ..... 347/87

(58) Field of Classification Search ..... 347/85, 347/86, 87, 92, 93
See application file for complete search history.

(56) References Cited

U.S. PATENT DOCUMENTS 5,576,750 A * 11/1996 Brandon et al. ..... 347/87
5,815,185 A * 9/1998 Pietrzyk ..... 347/92
5,909,231 A * 6/1999 Childers et al. ..... 347/92
5,969,739 A * 10/1999 Altendorf et al. ..... 347/87
6,193,356 B1 * 2/2001 Takata ..... 347/30
6,457,821 B1 * 10/2002 Liu et al. ..... 347/93
6,513,920 B1 * 2/2003 Deshmukh et al. ..... 347/92
6,547,379 B2 * 4/2003 Chan et al. ..... 347/92
6,634,742 B2 * 10/2003 Owaki et al. ..... 347/93
7,070,266 B2 * 7/2006 Ogawa et al. ..... 347/87
7,128,407 B2 * 10/2006 Inoue et al. ..... 347/85

* cited by examiner

*Primary Examiner*—Anh T. N. Vo

(57) ABSTRACT

In one embodiment, an ink pen includes an ink chamber, a passage and a printhead operatively connected to the ink chamber through the passage such that ink flowing from the ink chamber to the printhead passes through the passage. The passage includes an upstream part having a polygonal cross sectional area and a downstream part having a cross sectional area smaller than the polygonal cross sectional area.

17 Claims, 6 Drawing Sheets

FLOW PASSAGE

BACKGROUND

Inkjet printers utilize one or more printheads to deposit ink on paper and other print media. A printhead is a microelectromechanical part that contains an array of miniature thermal resistors or piezoelectric devices that are energized to eject small droplets of ink out of an associated array of orifices. Air can accumulate in the area near the printhead, particularly during periods of low or no printing. Air that accumulates near the printhead can eventually displace much of the ink at the printhead, starving the printhead for ink and rendering the printhead useless.

DRAWINGS

DESCRIPTION

Embodiments of the present invention were developed in an effort to allow air to move away from the printhead in an inkjet printer ink pen. An ink pen is also commonly referred to as an ink cartridge or an inkjet print head assembly. Exemplary embodiments of the invention will be described, therefore, with reference to an ink pen and inkjet printing. Embodiments of the invention, however, are not limited to ink pens or inkjet printing. The exemplary embodiments shown in the figures and described below illustrate but do not limit the invention. Other forms, details, and embodiments may be made and implemented. Hence, the following description should not be construed to limit the scope of the invention, which is defined in the claims that follow the description.

Figure 1:
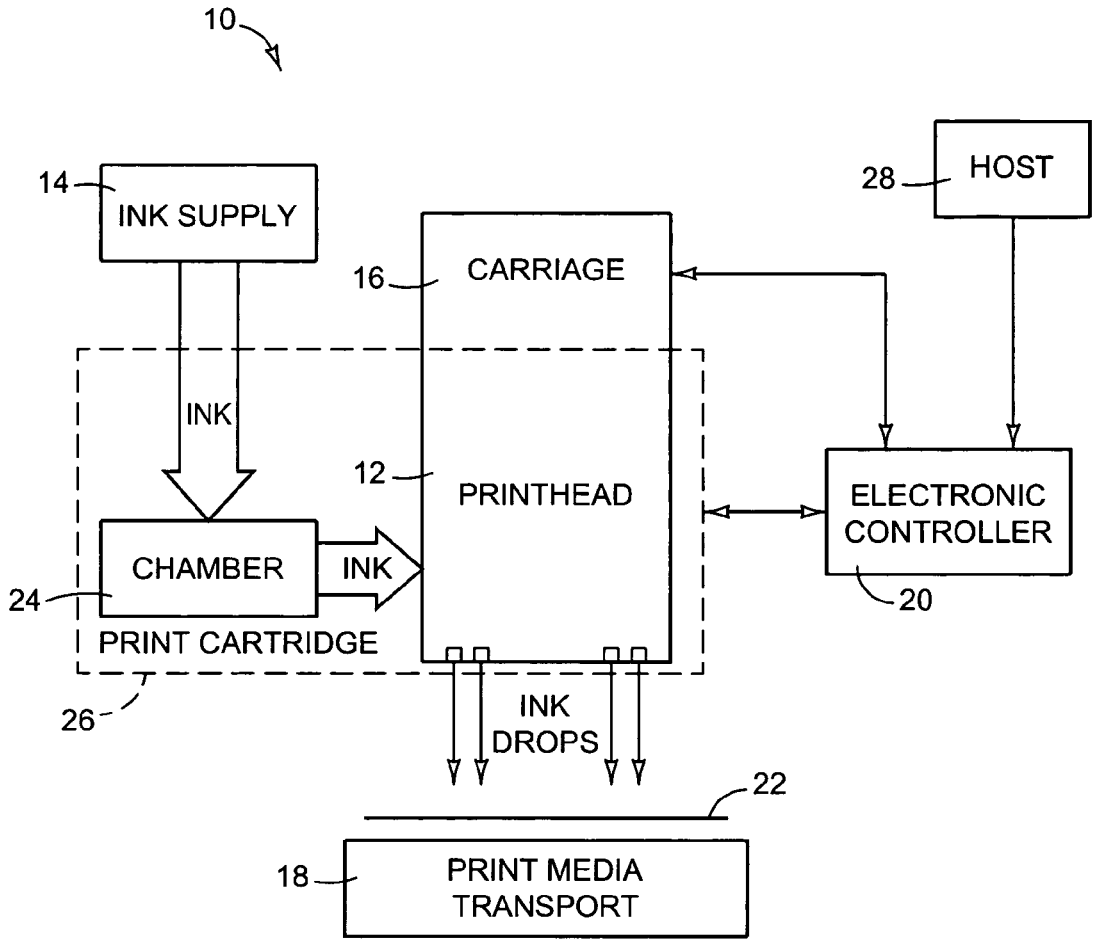
FIG. 1 is a block diagram illustrating an inkjet printer in which embodiments of the invention may be implemented.

Referring to FIG. 1, inkjet printer 10 includes a printhead 12, an ink supply 14, a carriage 16, a print media transport mechanism 18 and an electronic printer controller 20. Printhead 12 in FIG. 1 represents generally one or more printheads and the associated mechanical and electrical components for ejecting drops of ink on to a sheet or strip of print media 22. A typical thermal inkjet printhead includes a nozzle plate arrayed with ink ejection nozzles and firing resistors formed on an integrated circuit chip positioned behind the ink ejection nozzles. The ink ejection nozzles are usually arrayed in columns along the nozzle plate. Each printhead is electrically connected to printer controller 20 through external electrical contacts. In operation, printer controller 20 selectively energizes the firing resistors through the electrical contacts. When a firing resistor is energized, a vapor bubble forms in the ink vaporization chamber, ejecting a drop of ink through a nozzle on to the print media 22. In a piezoelectric printhead, piezoelectric elements are used to eject ink from a nozzle instead of firing resistors. Piezoelectric elements located close to the nozzles are caused to deform very rapidly to eject ink through the nozzles.

Printhead 12 may include a series of stationary printheads that span the width of print media 22. Alternatively, printhead 12 may include a single printhead that scans back and forth on carriage 16 across the width of media 22. Other printhead configurations are possible. A movable carriage 16, for example, may include a holder for printhead 12, a guide along which the holder moves, a drive motor, and a belt and pulley system that moves the holder along the guide. Media transport 18 advances print media 22 lengthwise past printhead 12. For a stationary printhead 12, media transport 18 may advance media 22 continuously past printhead 12. For a scanning printhead 12, media transport 18 may advance media 22 incrementally past printhead 12, stopping as each swath is printed and then advancing media 22 for printing the next swath.

Ink chamber 24 and printhead 12 are usually housed together in an ink pen 26, as indicated by the dashed line in FIG. 1. Ink supply 14 supplies ink to printhead 12 through ink chamber 24. Ink supply 14, chamber 24 and printhead 12 may be housed together in a single ink pen. Alternatively, ink supply 14 may be housed separate from ink chamber 24 and printhead 12, as shown, in which case ink is supplied to chamber 24 through a flexible tube or other suitable conduit.

Controller 20 receives print data from a computer or other host device 28 and processes that data into printer control information and image data. Controller 20 controls the movement of carriage 16 and media transport 18. As noted above, controller 20 is electrically connected to printhead 12 to energize the firing resistors to eject ink drops on to media 22. By coordinating the relative position of printhead 12 and media 22 with the ejection of ink drops, controller 20 produces the desired image on media 22 according to the print data received from host device 28.

Figure 2:
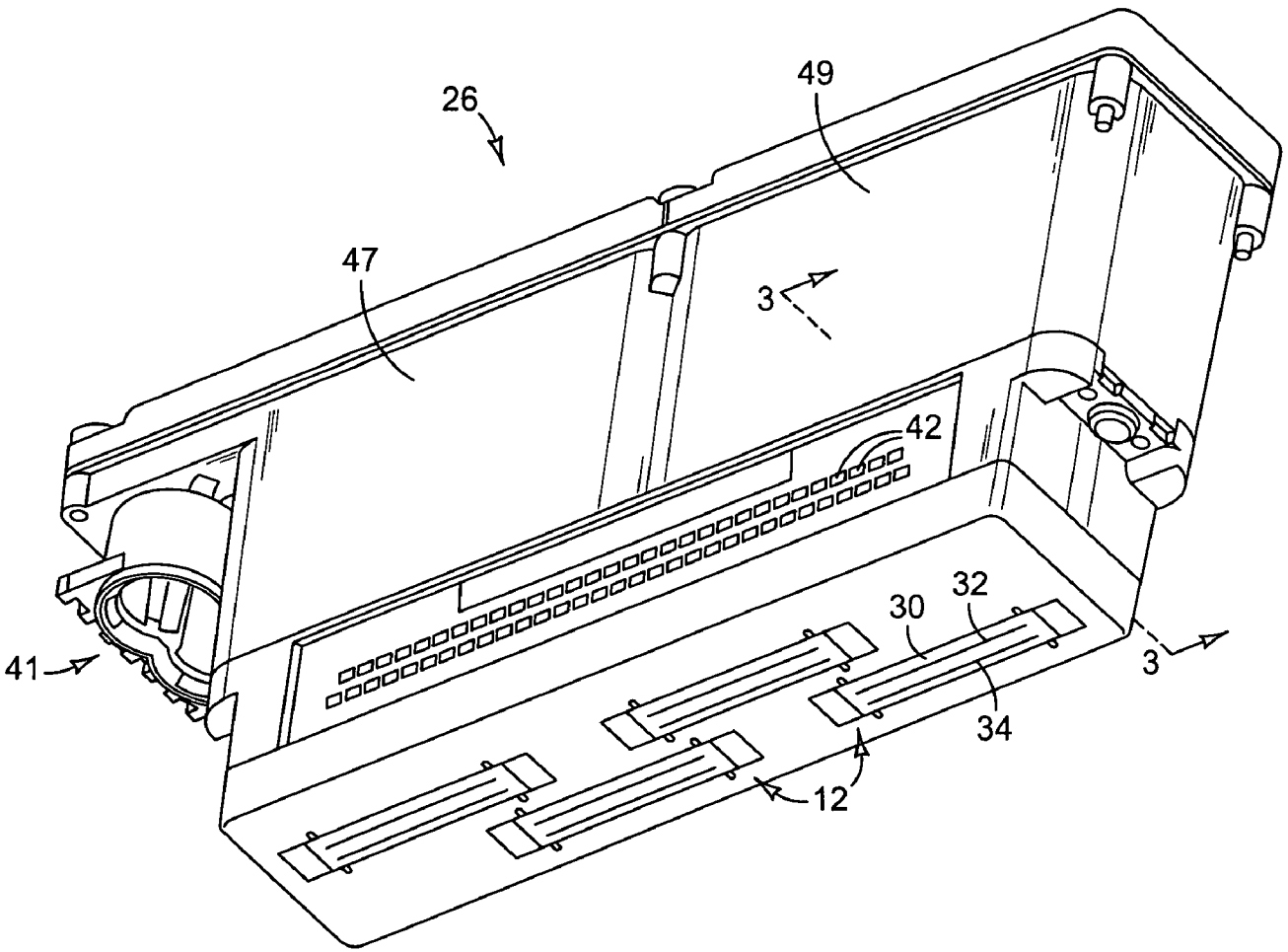
FIG. 2 is a perspective view illustrating an ink pen constructed according to one embodiment of the invention.
Figure 6:
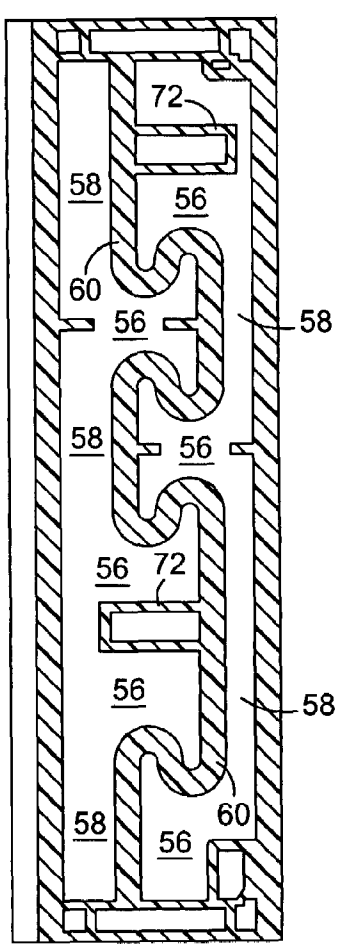
FIGS. 4-6 are plan section views taken along the lines 4-4, 5-5, and 6-6 respectively in FIG. 3.
Figure 5:
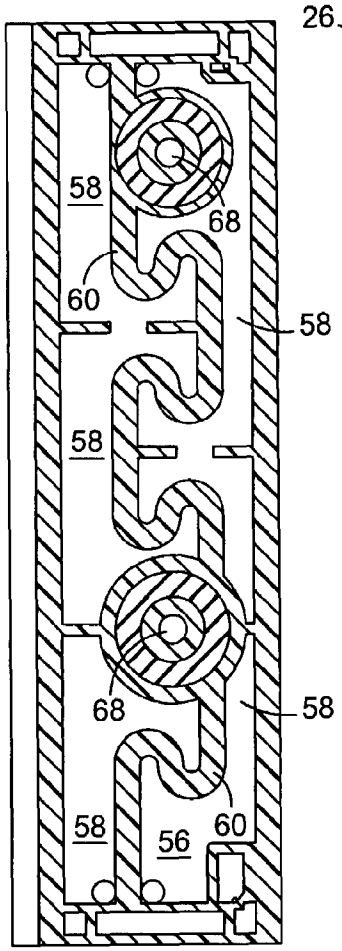
Figure 4:
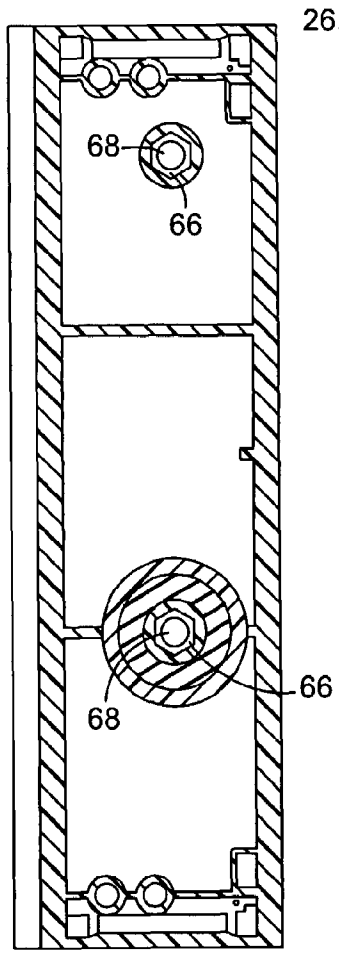
Figure 3:
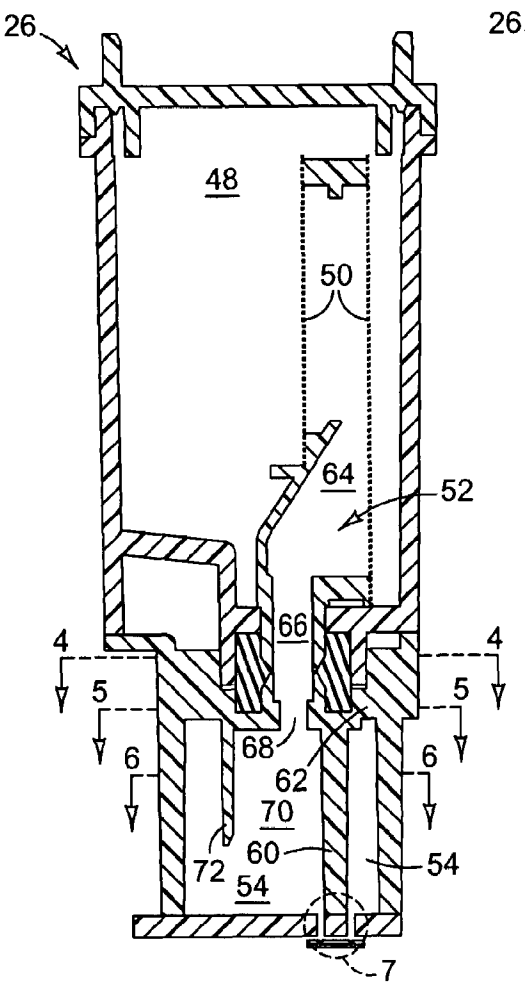
FIG. 3 is an elevation section view taken along the line 3-3 in FIG. 2.
Figure 7:
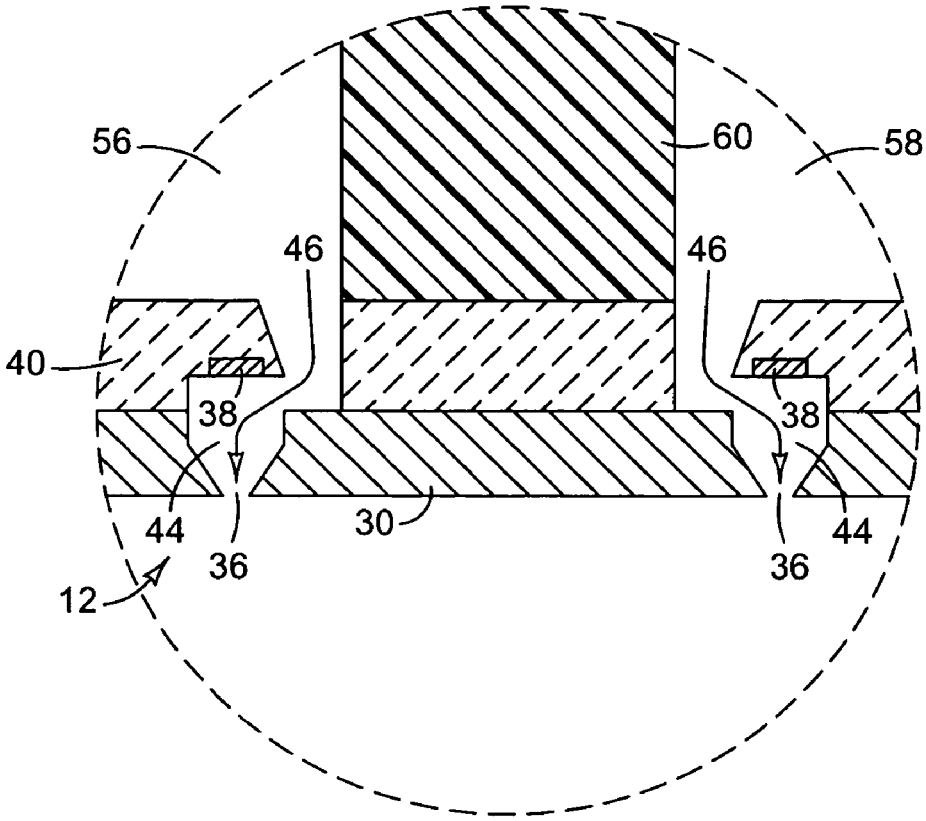
FIG. 7 is a detail view illustrating a printhead in the ink pen shown in FIG. 3.

FIG. 2 is a perspective view illustrating an ink pen 26 constructed according to one embodiment of the invention. FIG. 3 is an elevation section view of an ink pen 26 taken along the line 3-3 in FIG. 2. FIGS. 4-6 are plan section views taken along the lines 4-4, 5-5, and 6-6 in FIG. 3. FIG. 7 is a detail view illustrating a printhead 12 in ink pen 26. Referring to FIGS. 2-7, ink pen 26 includes printheads 12 located at the bottom of ink pen 26. As best seen in FIGS. 2 and 7, each printhead 12 includes an orifice plate 30 with two arrays 32, 34 of ink ejection orifices 36. In the embodiment shown, each array 32, 34 is a single column of orifices 36. Firing resistors 38 formed on an integrated circuit chip 40 are positioned behind ink ejection orifices 36.

When ink pen 26 is installed in a printer 10, ink pen 26 is connected to ink supply 14 through an ink receiving port 41 (FIG. 2) and pen 26 is electrically connected to the printer controller through electrical contacts 42 (FIG. 2). In operation, the printer controller selectively energizes firing resistors 38 through electrical contacts 42. When a firing resistor 38 is energized, ink in a vaporization chamber 44 next to a resistor 38 is vaporized, ejecting a droplet of ink through orifice 36 on to the print media. The low pressure created by ejection of the ink droplet and cooling of chamber 44 draws in ink to refill vaporization chamber 44 in preparation for the next ejection. The flow of ink through printhead 12 is illustrated by arrows 46 in FIG. 7.

In the embodiment shown, ink pen 26 is a two-color ink pen that includes a first color module 47 and a second color module 49. Referring now to the section views of FIGS. 3-6, in each module 47 and 49 (FIG. 2) ink flows from an upper holding chamber 48 through a filter 50 and passage 52 to a lower ink holding chamber 54 immediately adjacent to printhead 12. Lower ink holding chamber 54 is also sometimes referred to as a manifold because ink can be distributed to multiple printheads 12 (FIG. 2) through chamber/manifold 54. In some ink pens, a pressure regulator (not shown) in upper ink chamber 48 is used to maintain a slightly negative pressure in upper ink chamber 48 and manifold 54, helping prevent ink from drooling out of orifices 36 and providing a known reference pressure for orifice operation. Manifold 54 is partitioned into areas 56 and 58 associated with a respective ink color module 47 and 49. As shown in FIGS. 5 and 6, a winding partition 60 defines manifold areas 56 and 58 along the length of manifold 54 according to the pattern of printheads 12 in ink pen 26.

Each passage 52 includes an ink intake area or "filter volume" 64 (FIG. 3) adjacent to filter 50 along upper ink chamber 48, a polygonal part 66 downstream from intake area 64, a narrow circular part 68 downstream from polygonal part 66, and a rectangular part 70 extending into manifold 54 downstream from narrow circular part 68. Rectangular part 70 may be characterized as an ink discharge area of passage 52 extending into manifold 54, or as a partial partition of more broad areas 56 in manifold 54. In either case, rectangular part 70 is defined by a partition 72 that extends down from bulkhead 62 partially into manifold 54 and by partition 60 that extends down to printhead 12.

Figure 8:
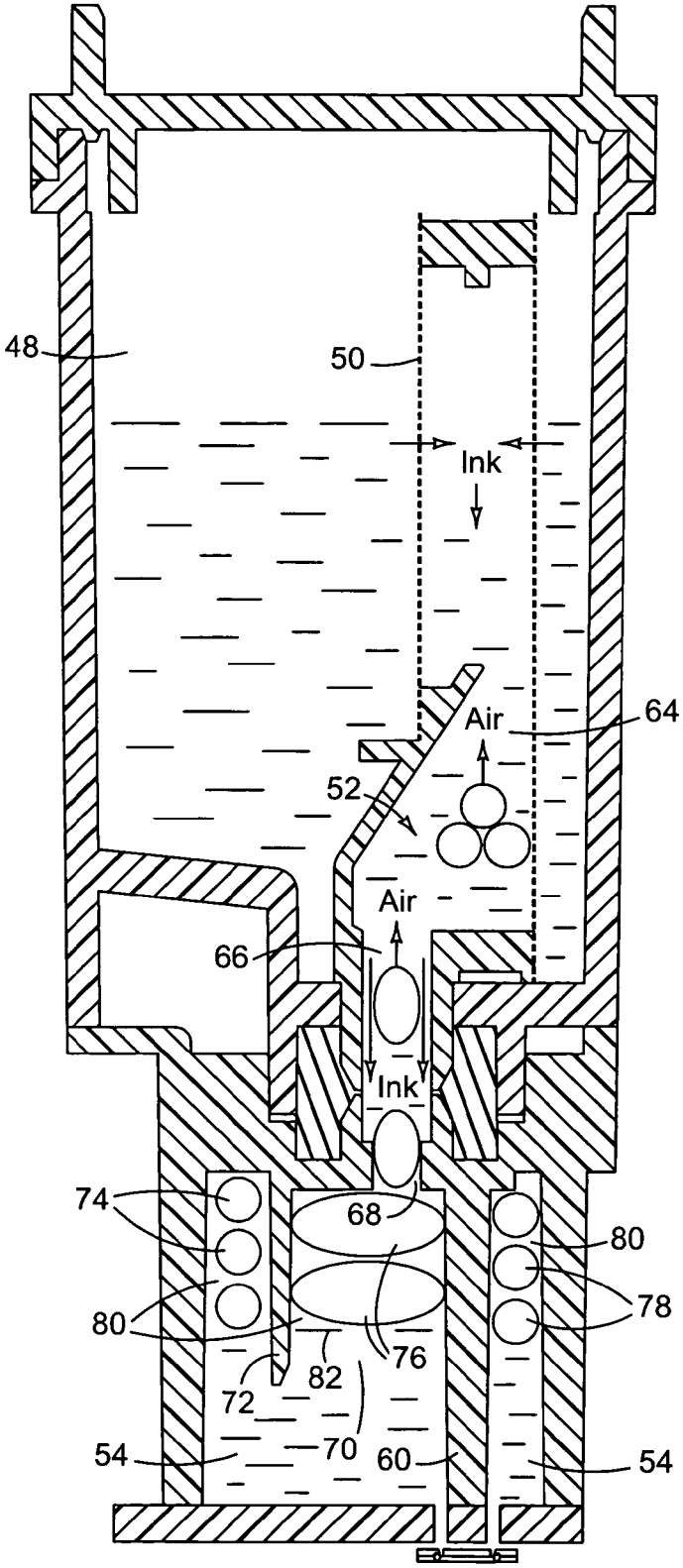
FIG. 8 is a detail view illustrating air movement in a flow passage of the ink pen shown in FIG. 3.

FIG. 8 illustrates air and ink movement in ink pen 26. Referring to FIG. 8, air in manifold 54 moves to the top of manifold 54 as indicated by bubbles 74, 76 and 78 in a "warehouse" space 80 above the level 82 of ink normally maintained in manifold 54. Partitions 60 and 72 extend down into manifold 54 below normal ink level 82. The narrow circular part 68 of passage 52 acts as an air block to prevent the rapid movement of air from manifold 54 to filter volume 64. Air block 68 is a short section of passage 52 immediately adjacent to discharge area 70. The cross sectional area of air block 68 is smaller than the cross sectional area of those parts of passage 52 immediately upstream (polygonal part 66) and downstream (discharge area 70). Surface tension of the ink prevents air from forming a bubble small enough to fit through air block 68 without a differential pressure to drive the bubble through air block 68. The diameter (or other cross sectional dimension(s)) of air block 68 is selected to so that the differential pressure between filter volume 64 and manifold 54 created by changes in atmospheric pressure or the heat generated in printhead 12 will drive air bubbles through air block 68. The length of air block 68 is selected so that the change in volume associated with the event(s) generating the pressure differential is sufficient to push the air bubbles all the way through air block 68. A longer air block 68 requires a larger change in volume to move an air bubble through to polygonal part 66 and, correspondingly, larger temperature and pressure excursions.

Figure 9:
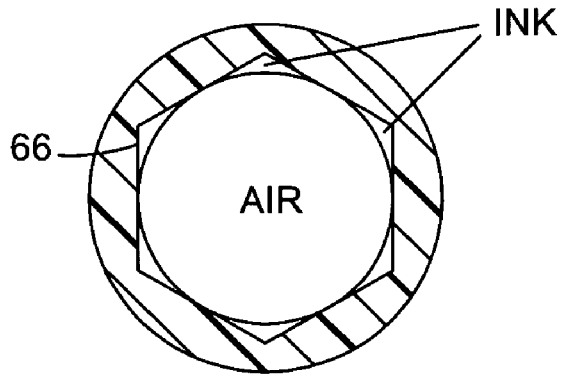
FIGS. 9-11 are detail views illustrating a hexagonal, pentagonal and octagonal cross section flow passage of an ink pen such as the pen shown in FIG. 3.
Figure 10:
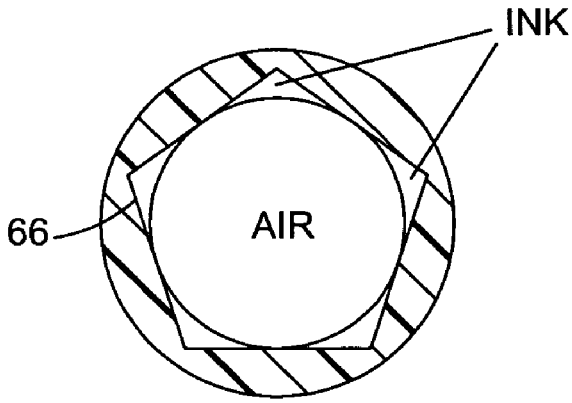
Figure 11:
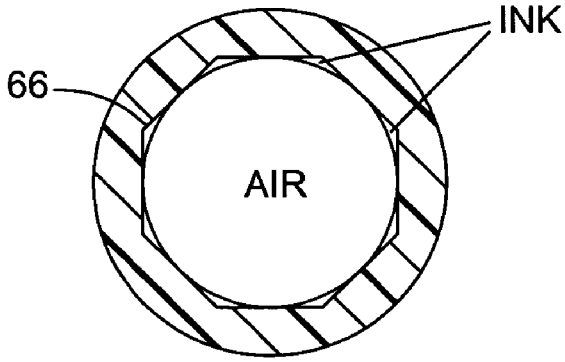

That part of passage 52 between filter volume 64 and air block 68 has a polygonal cross section. In the embodiment shown in FIGS. 4-5 and in the detail view of FIG. 9, polygonal part 66 has a hexagonal cross section. As shown in FIG. 8, air passing through polygonal part 66 forms into a cylindrical bubble constrained by the flats of the polygon. Aided by capillary action, ink flows down along the corners of the polygonal part 66 past air moving up through the passage. FIGS. 10 and 11 illustrate other examples of a polygonal part 66. In FIG. 10, polygonal part 66 has a pentagonal cross section that has a relatively greater area for ink flow past the air bubble. In FIG. 11, polygonal part 66 has an octagonal cross section that has a relatively lesser area for ink flow past the air bubble. For a typical inkjet printer pen generating differential pressures between filter volume 64 and manifold 54 on the order of tenths of an inch of water, for example, a circular air block nominally 2.0 mm in diameter and 2 mm long and a hexagonal part 66 nominally 3.2 mm across the flats will provide suitable air and ink movement through passage 52. Other suitable configurations are possible. For example, any polygonal cross section may be used to allow ink flow past air bubbles in part 66 as long as the number of flats is not so great that the cross section approximates a circle. That is to say, there must be sufficient space in the corners of the polygon to allow ink to flow past air bubbles in the passage.

As noted at the beginning of this Description, the exemplary embodiments shown in the figures and described above illustrate but do not limit the invention. Other forms, details, and embodiments may e made and implemented. Therefore, the foregoing description should not be construed to limit the scope of the invention, which is defined in the following claims.

What is claimed is:

1. An ink pen, comprising:

an ink chamber;

a passage;

a printhead operatively connected to the ink chamber through the passage such that ink flowing from the ink chamber to the printhead passes through the passage; and the passage including an upstream part having a polygonal cross sectional area, a first downstream part having a circular cross sectional area, and a second downstream part having a rectangular cross sectional area, the circular cross sectional area being smaller than the polygonal cross sectional area and smaller than the rectangular cross sectional area, the circular downstream part being concentric with the polygonal upstream part, and the polygonal upstream part having a cross sectional dimension from each flat side to another flat side small enough to constrain an air bubble passing through the polygonal upstream part.

2. The ink pen of claim 1, wherein the polygonal cross sectional area comprises a hexagonal cross sectional area.

3. The ink pen of claim 1, further comprising a manifold interposed between the passage and the printhead, the rectangular downstream part configured to discharge ink to the manifold, and the manifold configured to distribute ink to the printhead.

4. The ink pen of claim 1, further comprising a filter interposed between the ink chamber and the passage.

5. The ink pen of claim 1, wherein the circular cross sectional area of the circular downstream part is uniform along a full length of the circular downstream part.

6. The ink pen of claim 1, wherein the circular downstream part has a cross sectional dimension approximately equal to a full length of the circular downstream part.

7. The ink pen of claim 1, further comprising the circular downstream part having a cross sectional dimension substantially equal to the cross sectional dimension of the polygonal upstream part.

8. An ink pen, comprising:

a first chamber;

a passage;

a second chamber downstream from the first chamber along the passage;

a printhead operatively connected to the first chamber through the passage and the second chamber such that ink flowing from the first chamber to the printhead passes through the passage and the second chamber;

the passage including a polygonal cross sectional part, a circular cross sectional part downstream the polygonal cross sectional part, and a rectangular cross sectional part downstream the circular cross sectional part, the circular cross sectional part concentric with the polygonal cross sectional part, and the circular cross sectional part having a cross sectional area smaller than that of the polygonal cross sectional part and smaller than that of the rectangular cross sectional part; and the passage configured to simultaneously allow ink flow from the first chamber toward the second chamber and air flow from the second chamber toward the first chamber.

9. The ink pen of claim 8, further comprising the polygonal cross sectional part of the passage having a cross sectional dimension from each flat side to another flat side small enough to constrain an air bubble passing through the polygonal cross sectional part of the passage from the second chamber toward the first chamber.

10. The ink pen of claim 9, further comprising the circular cross sectional part of the passage having a cross sectional dimension substantially equal to the cross sectional dimension of the polygonal cross sectional part of the passage.

11. An ink pen, comprising:

an ink chamber;

a passage;

a printhead operatively connected to the ink chamber through the passage such that ink flowing from the ink chamber to the printhead passes through the passage; and the passage including an upstream part configured to simultaneously allow ink flow from the ink chamber toward the printhead and air flow from the printhead toward the ink chamber, a first downstream part configured to block air flow from the printhead toward the ink chamber unless a difference in pressure exists across the first downstream part of the passage sufficient to move an air bubble through the first downstream part of the passage, and a second downstream part configured to discharge ink to the printhead, the first downstream part being concentric with the upstream part and having a cross sectional area smaller than that of the upstream part and smaller than that of the second downstream part, wherein the upstream part comprises an upstream part having a polygonal cross sectional area, the polygonal upstream part having a cross sectional dimension from each flat side to another flat side small enough to constrain an air bubble passing through the polygonal upstream part, wherein the first downstream part comprises a downstream part having a circular cross sectional area and the second downstream part comprises a downstream part having a rectangular cross sectional area, the circular downstream part being concentric with the polygonal upstream part and the circular cross sectional area being smaller than the polygonal cross sectional area and smaller than the rectangular cross sectional area.

12. The ink pen of claim 11, wherein the printhead comprises a plurality of printheads operatively connected to the ink chamber and the ink pen further comprising a manifold between the passage and the printheads, the second downstream part configured to discharge ink to the manifold, and the manifold configured to distribute ink to each of the printheads.

13. A method, comprising simultaneously allowing fluid flow in a first direction and air flow in a second direction opposite the first direction in a first part of a passage, blocking air flow in the second direction in a second part of the passage downstream relative to fluid flow from the first part of the passage unless a difference in pressure exists across the second part of the passage sufficient to move an air bubble through the second part of the passage, and discharging fluid in the first direction in a third part of the passage downstream relative to fluid flow from the second part of the passage, the first part of the passage having a polygonal cross sectional area, the second part of the passage having a rectangular cross sectional area, and the third part of the passage having a circular cross sectional area, the second part of the passage being concentric with the first part of the passage and having a cross sectional area smaller than that of the first part of the passage and smaller than that of the third part of the passage.

14. The method of claim 13, further comprising chambering fluid upstream relative to fluid flow from the first part of the passage and distributing fluid to plural destinations downstream relative to fluid flow from the third part of the passage.

15. The method of claim 14, further comprising filtering fluid flowing into the first part of the passage.

16. The method of claim 13, further comprising warehousing air downstream relative to fluid flow from the second part of the passage.

17. A flow passage, comprising:

upstream means relative to fluid flow for simultaneously allowing fluid flow in a first direction and air flow in a second direction opposite the first direction, first downstream means relative to fluid flow for blocking air flow in the second direction unless a difference in pressure exists across the first downstream means sufficient to move an air bubble through the first downstream means, and second downstream means relative to fluid flow for discharging fluid in the first direction, the first downstream means being concentric with the upstream means and having a cross sectional area smaller than that of the upstream means and smaller than that of the second downstream means, wherein the upstream means comprises an upstream passage part having a polygonal cross sectional area, the second downstream means comprises a downstream passage part having a rectangular cross sectional area, and the first downstream means comprises a downstream passage part having a circular cross sectional area smaller than the polygonal cross sectional area and smaller than the rectangular cross sectional area, the polygonal upstream passage part having a cross sectional dimension from one flat side to another flat side small enough to constrain an air bubble passing through the polygonal upstream passage part.

* * * * *